US010569294B1

(12) United States Patent
Lee

(10) Patent No.: US 10,569,294 B1
(45) Date of Patent: Feb. 25, 2020

(54) HOT MELT GLUE GUN WITH AN AUTOMATIC GLUE STICK STRUCTURE

(71) Applicant: HOMEEASE INDUSTRIAL CORPORATION LTD., Chia Yi Hsien (TW)

(72) Inventor: Grace Lee, Chia Yi Hsien (TW)

(73) Assignee: HOMEEASE INDUSTRIAL CORPORATION, LTD, Chia Yi Hsien (TW)

( * ) Notice: Subject to any disclaimer, the term of this patent is extended or adjusted under 35 U.S.C. 154(b) by 0 days.

(21) Appl. No.: 16/125,473

(22) Filed: Sep. 7, 2018

(51) Int. Cl.
*B05C 5/00* (2006.01)
*B05C 17/00* (2006.01)
*B05C 17/005* (2006.01)

(52) U.S. Cl.
CPC ..... *B05C 17/003* (2013.01); *B05C 17/0052* (2013.01); *B05C 17/00526* (2013.01); *B05C 5/001* (2013.01); *B05C 17/00523* (2013.01); *B05C 17/00546* (2013.01)

(58) Field of Classification Search
CPC ..... B05C 5/001; B05C 17/00523; B05C 17/00456
USPC ..... 222/146.5; 401/2
See application file for complete search history.

(56) References Cited

U.S. PATENT DOCUMENTS 3,604,597 A * 9/1971 Pohl ..... B29B 13/022 222/146.5
4,781,482 A * 11/1988 Ursprung ..... B05C 17/0053 219/229
4,938,388 A * 7/1990 Yeh ..... B05C 17/00536 219/241
6,558,059 B1 * 5/2003 Hillinger ..... B05C 17/00536 222/146.2
9,586,229 B1 3/2017 Lee

* cited by examiner

*Primary Examiner* — David J Walczak
*Assistant Examiner* — Joshua R Wiljanen
(74) *Attorney, Agent, or Firm* — Fresh IP PLLC; Aubrey Y Chen

(57) ABSTRACT

An improved hot melt glue gun with an automatic glue stick feeding structure includes a housing that is gun-shaped and that includes an inlet and an outlet. A glue stick feeding module is mounted in the housing and located adjacent to the inlet. The glue stick feeding module includes a motor connected to a casing. The casing includes a passage and a through-hole. The passage is located in the casing and intercommunicates with the inlet. The through-hole is aligned with the passage in a transverse direction. An activation module includes an activation rod reciprocatingly and movably extending through the through-hole. A micro switch is located adjacent to the activation module and is electrically connected to the motor. The micro switch is configured to be pressed by the activation rod to activate the motor. A hot melt module is mounted in the housing and located adjacent to the outlet.

11 Claims, 5 Drawing Sheets

HOT MELT GLUE GUN WITH AN AUTOMATIC GLUE STICK STRUCTURE

BACKGROUND OF THE INVENTION

The present invention relates to a hot melt glue gun and, more particularly, to an improved hot melt glue gun using electricity to generate high heat for melting a glue stick.

A type of an automatic hot melt glue gun includes a gun-shaped housing and a press button coupled to the housing. A glue stick feeding device and a hollow hot melt unit are mounted in the housing. The glue stick feeding device includes a transmission gear and a plurality of gears. The plurality of gears form a passage through which a glue stick extends. The hot melt unit is aligned with the passage. When the press button is pressed, the transmission gear rotates to move the glue stick forwards, pushing molten glue in the hot melt unit to flow out of a nozzle. An example of the automatic hot melt glue gun is disclosed in U.S. Pat. No. 9,586,229 B1 entitled "HOT MELT GLUE GUN WITH AN AUTOMATIC GLUE STICK FEEDING STRUCTURE."

However, in the above conventional automatic hot melt glue gun, when a distal end of the glue stick moves forwards and, thus, leaves the plurality of gears, since the glue stick feeding device is hidden in the housing, the user cannot know if there are no glue sticks left in the passage. If the user continues to press the press button, the transmission gear and the plurality of gears rotate idly, and there is no molten glue flowing out of the outlet, resulting in interruption of supply of glue. Even if a new glue stick is inserted immediately, a spacing exists between the front end of the new glue stick and the rear end of the preceding glue stick, which also causes interruption of supply of glue, rendering discontinuous operation. Consequently, the conventional automatic hot melt glue gun is inconvenient to use.

Thus, improvement to the conventional automatic hot melt glue gun is necessary.

BRIEF SUMMARY OF THE INVENTION

To solve the above problem, an objective of the present invention is to provide an improved hot melt glue gun with an automatic glue stick feeding structure to avoid interruption of supply of glue.

Another objective of the present invention is to provide an improved hot melt glue gun with an automatic glue stick feeding structure providing enhanced assembling convenience.

A further objective of the present invention is to provide an improved hot melt glue gun with an automatic glue stick feeding structure with a reduced manufacturing cost.

Still another objective of the present invention is to provide an improved hot melt glue gun with an automatic glue stick feeding structure providing enhanced coupling reliability.

An improved hot melt glue gun with an automatic glue stick feeding structure according to the present invention includes a housing that is gun-shaped and that includes an inlet and an outlet. A glue stick feeding module is mounted in the housing and located adjacent to the inlet. The glue stick feeding module includes a motor connected to a casing. The casing includes a passage and a through-hole. The passage is located in the casing and intercommunicates with the inlet. The through-hole is aligned with the passage in a transverse direction. An activation module includes an activation rod reciprocatingly and movably extending through the through-hole. A micro switch is located adjacent to the activation module and is electrically connected to the motor. The micro switch is configured to be pressed by the activation rod to activate the motor. A hot melt module is mounted in the housing and located adjacent to the outlet.

Thus, the user of the hot melt glue gun according to the present invention can know whether it is necessary to supply the glue stick by judging whether the motor is in the energized state or the off state. Consequently, the activation rod can be continuously pressed by a glue stick to assure that the front end of the new glue stick abuts the rear end of the preceding glue stick. As a result, the hot melt glue gun according to the present invention can prevent interruption of supply of glue, enhancing use convenience.

In an example, the housing includes a first compartment and a second compartment. The first compartment is located adjacent to and intercommunicates with the inlet. The second compartment is located adjacent to and intercommunicates with the outlet. Thus, the glue stick can be smoothly inserted through the inlet, and molten glue can flow smoothly out of the outlet.

In an example, the casing includes a first casing part and a second casing part. The first casing part is located between the motor and the second casing part. Thus, the assembling convenience is enhanced.

In an example, the motor includes a transmission shaft extending through a through-hole of the first casing part. A transmission gear is mounted to the transmission shaft. The transmission gear is located in the casing and is driven by the transmission shaft to rotate. Thus, smooth rotation of the transmission gear can be enhanced.

In an example, the glue stick feeding module includes at least one upper gear and at least one lower gear located below and aligned with the at least one upper gear. The passage is defined between the at least one upper gear and the at least one lower gear. Thus, the structure is simple, and the glue stick can easily move forwards.

In an example, the at least one upper gear and the at least one lower gear are mounted to two positioning shafts, respectively. Thus, the at least one upper gear and the at least one lower gear can be more stably positioned in the casing.

In an example, the activation module includes a fixed seat, and an elastic element is mounted between the activation rod and the fixed seat. Thus, the activation rod can easily and reciprocatingly move relative to the first casing part.

In an example, the activation rod includes a first end, a second end, a larger-diameter pressing portion, and a smaller-diameter pressing portion. The larger-diameter pressing portion is adjacent to the first end. The smaller-diameter pressing portion is adjacent to the second end. Thus, a single activation rod is sufficient to switch the motor between an energized state and an off state, reducing the manufacturing cost.

In an example, the hot melt module includes a tube having an end aligned with the passage, and the tube further has another end intercommunicating with the outlet. Thus, the molten glue can flow more smoothly out of the outlet.

In an example, the hot melt module includes a heating member fixed to an outer wall of the tube, such that the glue stick in the tube can melt rapidly.

In an example, the tube is made of metal to increase the heat conduction efficiency.

The present invention will become clearer in light of the following detailed description of illustrative embodiments of this invention described in connection with the drawings.

Figure 1:
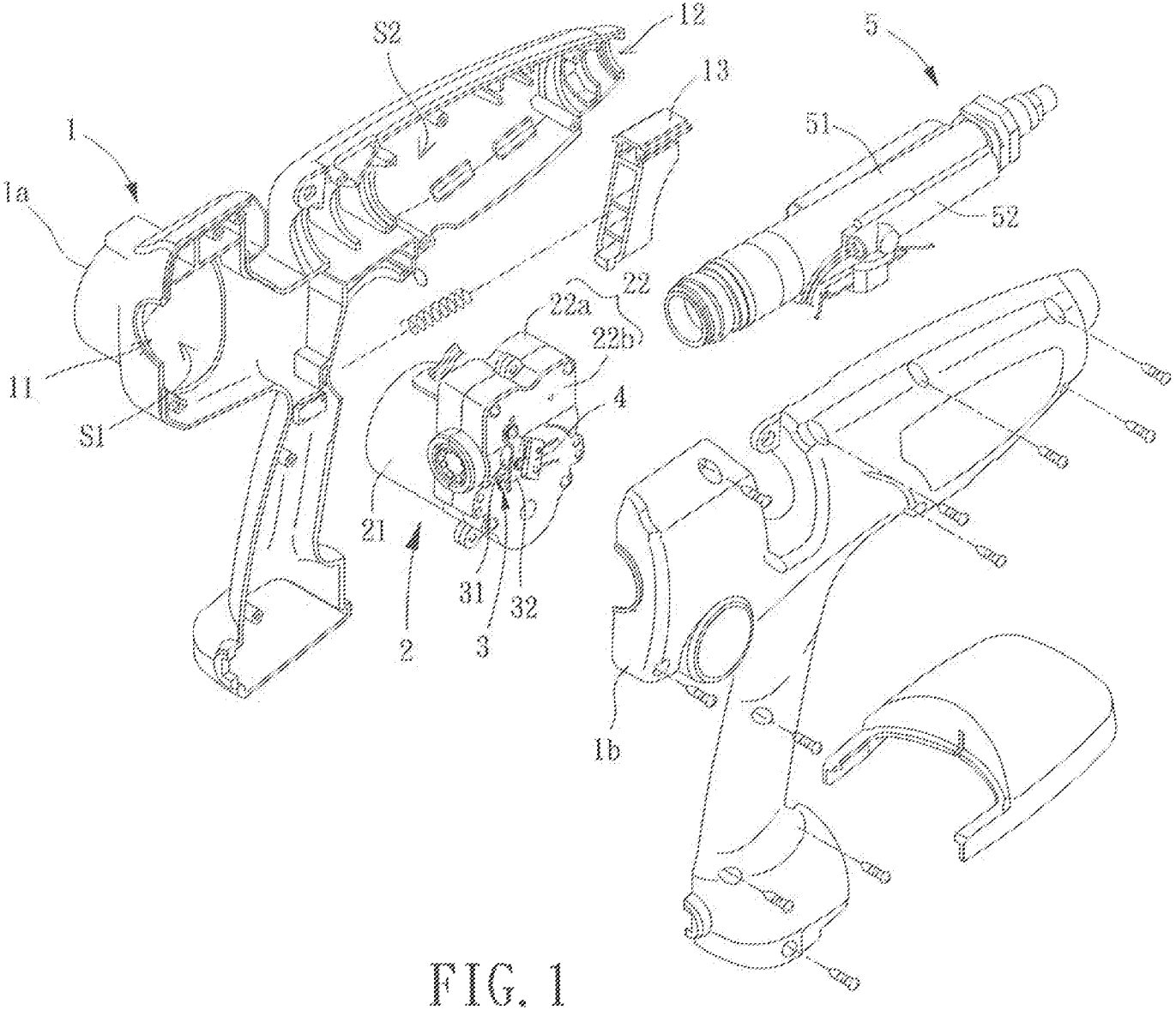
FIG. 1 is an exploded, perspective view of a hot melt glue gun of an embodiment according to the present invention.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

DETAILED DESCRIPTION OF THE INVENTION

With reference to FIG. 1, a hot melt glue gun of an embodiment according to the present invention includes a housing 1, a glue stick feeding device 2, an activation module 3, a micro switch 4, and a hot melt module 5. The glue stick feeding device 2 is mounted in the housing 1. The activation module 3 and the micro switch 4 are located in the glue stick feeding device 2. The hot melt module 5 is spaced from the glue stick feeding device 2.

The housing 1 is gun-shaped and includes a first housing part 1*a* and a second housing part 1*b*. Preferably, the first housing part 1*a* and the second housing part 1*b* are disposed in mirror image symmetry. Furthermore, the first housing part 1*a* and the second housing part 1*b* are coupled to form the housing 1. The housing 1 includes an inlet 11 and an outlet 12. A glue stick Y can be inputted through the inlet 11, and molten glue can be outputted through the outlet 12. The housing 1 includes a first compartment S1 and a second compartment S2. The first compartment S1 is located adjacent to and intercommunicates with the inlet 11. The second compartment S2 is located adjacent to and intercommunicates with the outlet 12. Furthermore, the housing 1 includes a press button 13 preferably located below the second compartment S2 and configured to be pressed by a user.

Figure 2:
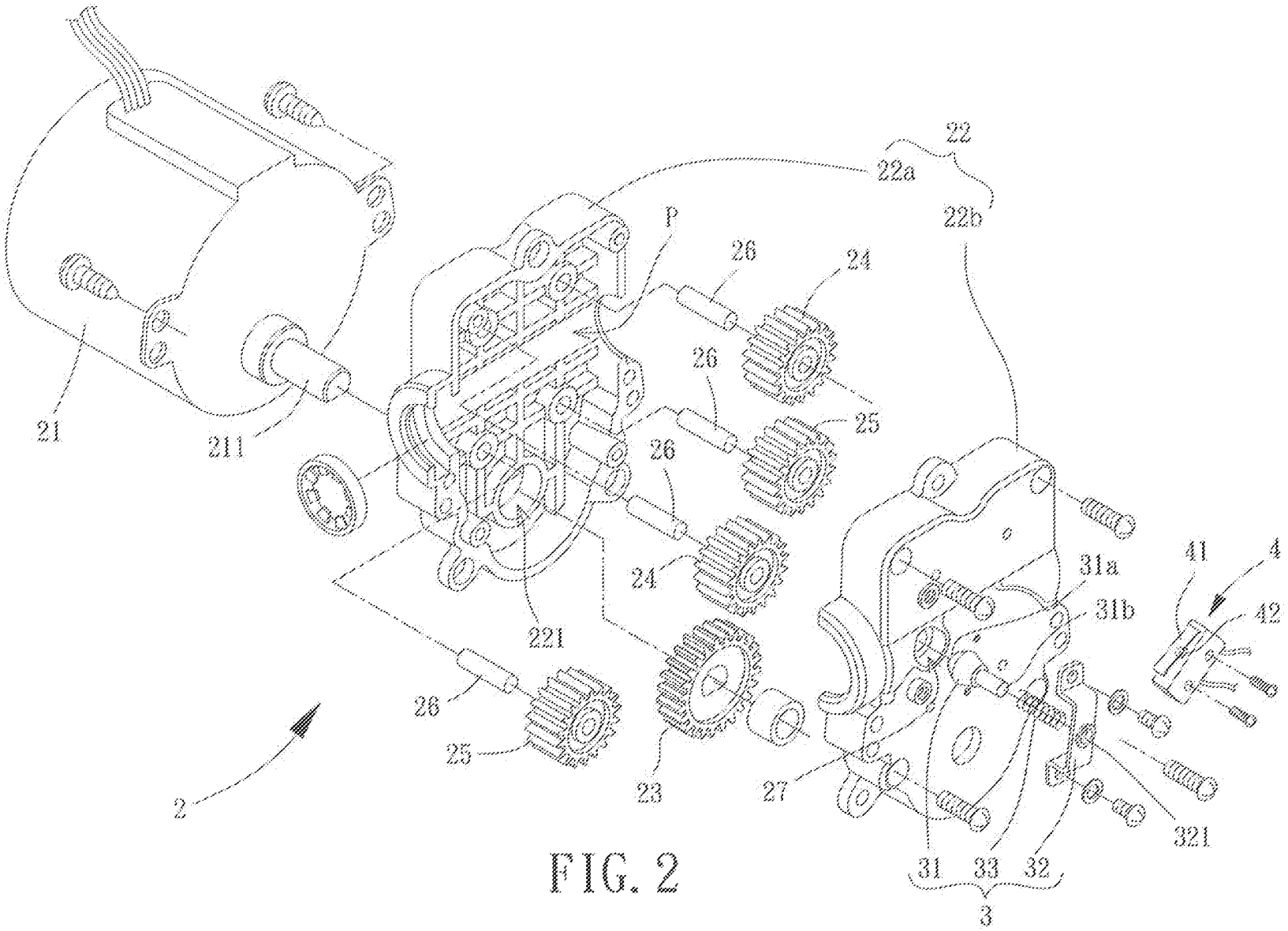
FIG. 2 is an exploded, perspective view of a portion of the hot melt glue gun of FIG. 1.

With reference to FIGS. 1 and 2, the glue stick feeding device 2 is located in the first compartment S1 and includes a motor 21 connected to a casing 22. In this embodiment, the casing 22 includes a first casing part 22*a* and a second casing part 22*b*, and the first casing part 22*a* is located between the motor 21 and the second casing part 22*b*. Specifically, the motor 21 includes a transmission shaft 211 extending through a through-hole 221 of the first casing part 22*a*. A transmission gear 23 is mounted to the transmission shaft 211. The transmission gear 23 is located in the casing 22 and is driven by the transmission shaft 211 to rotate. Furthermore, the glue stick feeding module 2 includes at least one upper gear 24 and at least one lower gear 25. The at least one upper gear 24 and the at least one lower gear 25 are mounted to two positioning shafts 26, respectively. Thus, the at least one upper gear 24 and the at least one lower gear 25 are rotatably positioned between the first casing part 22*a* and the second casing part 22*b*. In this embodiment, the glue stick feeding device 2 includes two upper gears 24 and two lower gears 25.

Figure 3:
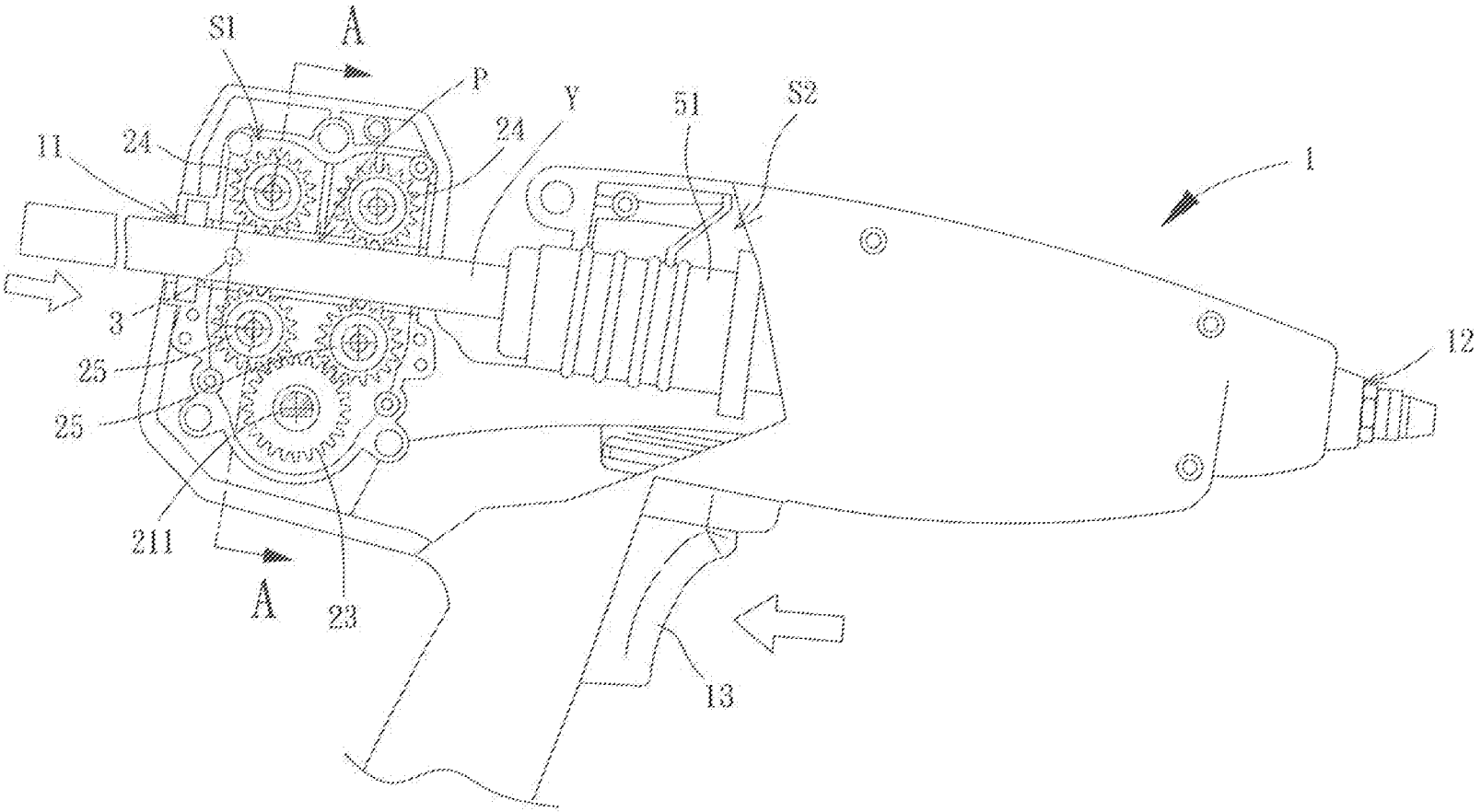
FIG. 3 is a side view of the hot melt glue gun of FIG. 1 after assembly.

With reference to FIGS. 2 and 3, preferably, the two lower gears 25 are located below and aligned with the two upper gears 24 to define a passage P between the two upper gears 24 and the two lower gears 25. The glue stick Y abuts against the two upper gears 24 and the two lower gears 25. Furthermore, at least one lower gear 25 meshes with the transmission gear 23 that is driven to rotate by the transmission shaft 211. Furthermore, the transmission gear 23 can drive the lower gear 25 to rotate. Thus, the glue stick Y moves towards the second chamber S2. The glue stick feeding device 2 further includes a through-hole 27 located in the second casing part 22*b* and aligned with the passage P in a transverse direction.

With reference to FIG. 2, the activation module 3 is located in the second casing part 22*b* of the glue stick feeding device 2. The activation module 3 includes an activation rod 31 and a fixed seat 32. The activation rod 31 extends through the through-hole 27 of the second casing part 22*b*. The activation rod 31 includes a first end 31*a* and a second end 31*b*. The first end 31*a* of the activation rod 31 faces the passage P and can be pushed by the glue stick Y. Furthermore, the second end 31*b* of the activation rod 31 extends through a through-hole 321 of the fixed seat 32. An elastic element 33 is mounted between the activation rod 31 and the fixed seat 32.

Figure 4:
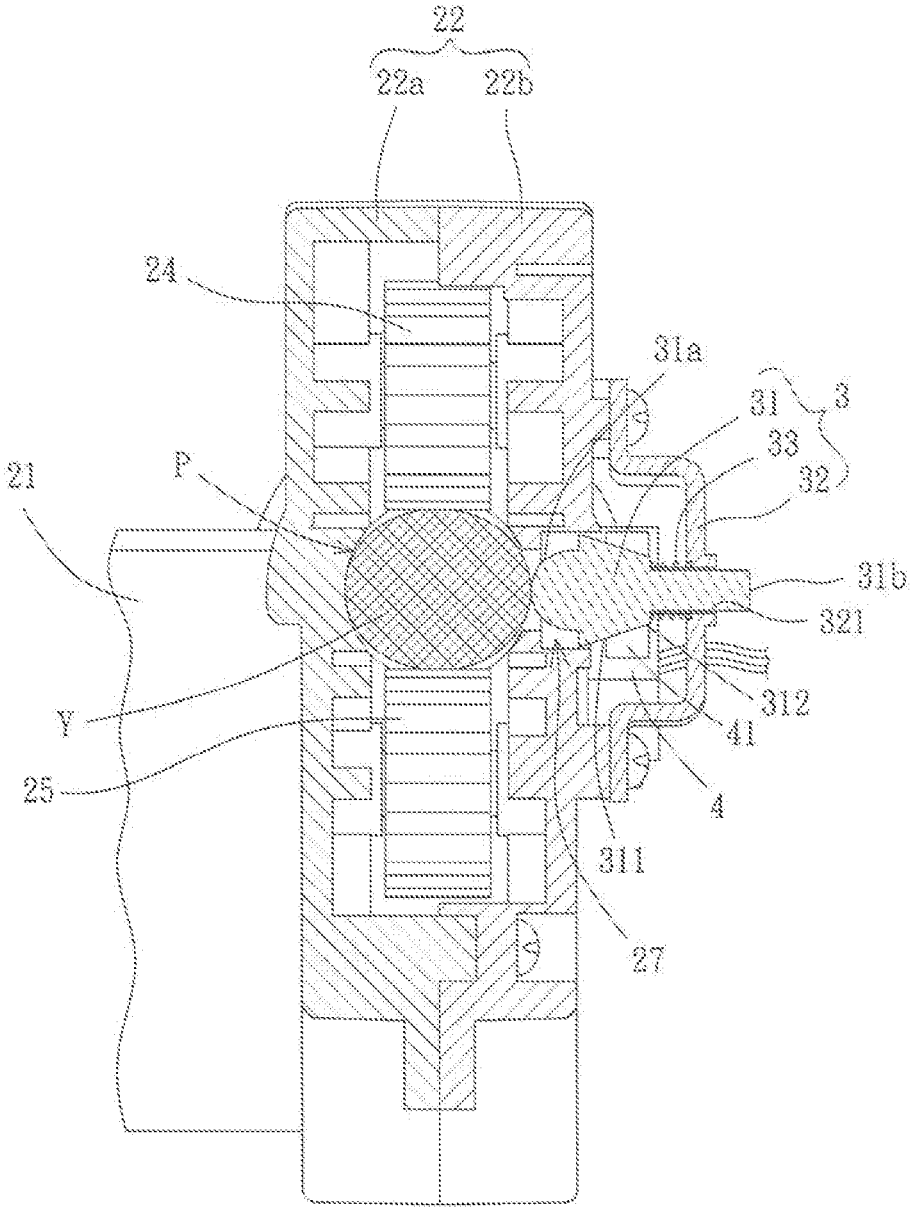
FIG. 4 is a cross sectional view taken along section line A-A of FIG. 3.
Figure 5:
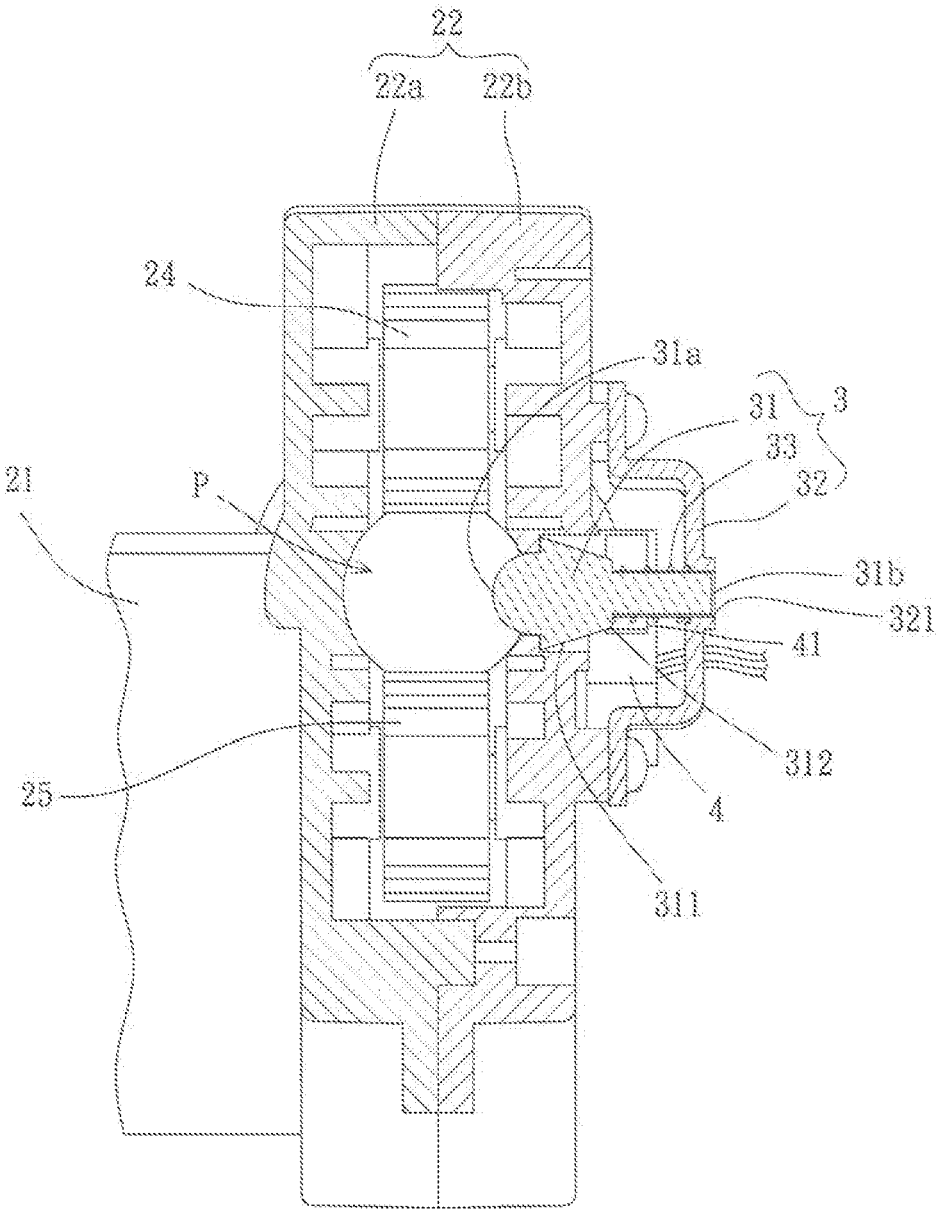
FIG. 5 is a view similar to FIG. 4, illustrating operation of the hot melt glue gun.

With reference to FIGS. 2, 4, and 5, when the glue stick Y pushes the first end 31*a* of the activation rod 31, the elastic element 33 is compressed, and the activation rod 31 moves away from the first casing part 22*a*. When the glue stick Y does not push the first end 31*a* of the activation rod 31, the elastic element 33 is in its extended state, such that the activation rod 31 moves towards the first casing part 22*a*. Specifically, in this embodiment, the activation rod 31 can have a larger-diameter pressing portion 311 and a smaller-diameter pressing portion 312. The larger-diameter pressing portion 311 and the smaller-diameter pressing portion 312 are located between the first end 31*a* and the second end 31*b*. The larger-diameter pressing portion 311 is adjacent to the first end 31*a*, and the smaller-diameter pressing portion 312 is adjacent to the second end 31*b*.

With reference to FIG. 2, the micro switch 4 is located outside of the second casing part 22*b* of the glue stick feeding device 2. The micro switch 4 is located adjacent to the activation module 3 and can be pressed by the activation rod 31. The micro switch 4 is electrically connected to the motor 21. Specifically, the micro switch 4 includes a resilient plate 41 and an activation button 42. When the resilient plate 41 presses against the activation button 42, the motor 221 is energized. On the other hand, when the resilient plate 41 does not press against the activation button 42, the motor 21 is in an off state.

With reference to FIGS. 1 and 3, the hot melt module 5 is mounted in the second compartment S2 of the housing 1. The hot melt module 5 includes a tube 51 and a heating member 52. The tube 51 is preferably made of metal. An end of the tube 51 is aligned with the passage P, permitting insertion of the glue stick Y into the tube 51. The other end of the tube 51 intercommunicates with the outlet 12. Furthermore, the heating member 52 is fixed to an outer wall of the tube 51. The heating member 52 can generate high heat that is conducted through the outer wall of the tube 51 to melt the glue stick Y in the tube 51 into molten glue.

With reference to FIGS. 2-4, in use of the hot melt glue gun with the above structure, the glue stick Y is inserted into the passage P via the inlet 11, such that the outer periphery of the glue stick Y presses against the first end 31*a* of the activation rod 31, moving the activation rod 31 away from the first casing part 22*a*. Furthermore, the larger-diameter pressing portion 311 of the activation rod 31 presses against the resilient plate 41 of the micro switch 4, and the resilient plate 41 presses against the activation button 42 to thereby energize the motor 21. At this time, when the press button 13 is pressed, the transmission gear 23 is driven by the transmission shaft 211 to rotate the at least one gear 25, moving the glue stick Y towards the second chamber S2. Furthermore, the molten glue in the hot melt module 5 can flow out of the outlet 12.

With reference to FIGS. 2, 3, and 5, after the glue stick Y has been used for a period of time, since the glue stick Y moves towards the second chamber S2, there are no glue sticks Y left in the passage P aligned with the through-hole 27, such that the outer periphery of the glue stick Y no longer presses against the first end 31*a* of the activation rod 31. Therefore, the activation rod 31 moves towards the first casing part 22*a*, such that the smaller-diameter pressing portion 312 of the activation rod 31 presses against the resilient plate 41 of the micro switch 4. Thus, the resilient plate 41 cannot press against the activation button 42, and the motor 21 cannot be energized. As a result, the motor 21 is in an off state. In this case, even if the press button 13 is pressed, the transmission shaft 211 and the transmission gear 23 will not rotate. Thus, the user can be aware of that the activation rod 31 is not pressed by the glue stick Y. The user can insert a new glue stick Y via the inlet 11 to press against the activation rod 31, assuring that the front end of the new glue stick Y abuts the rear end of the preceding glue stick Y, maintaining the motor 21 in the energized state.

In view of the foregoing, the user of the hot melt glue gun according to the present invention can know whether it is necessary to supply the glue stick Y by judging whether the motor 21 is in the energized state or the off state. Consequently, the activation rod 31 can be continuously pressed by a glue stick Y to assure that the front end of the new glue stick Y abuts the rear end of the preceding glue stick Y. As a result, the hot melt glue gun according to the present invention can prevent interruption of supply of glue, enhancing use convenience.

Although specific embodiments have been illustrated and described, numerous modifications and variations are still possible without departing from the scope of the invention. The scope of the invention is limited by the accompanying claims.

The invention claimed is:

1. An improved hot melt glue gun with an automatic glue stick feeding structure comprising:

a housing, wherein the housing is gun-shaped and includes an inlet and an outlet;

a glue stick feeding module mounted in the housing and located adjacent to the inlet, wherein the glue stick feeding module includes a motor connected to a casing, wherein the casing includes a passage and a through-hole, wherein the passage is located in the casing and intercommunicates with the inlet, and wherein the through-hole is aligned with the passage in a transverse direction;

an activation module including an activation rod reciprocatingly and movably extending through the through-hole;

a micro switch located adjacent to the activation module and electrically connected to the motor, wherein the micro switch is configured to be pressed by the activation rod to activate the motor; and a hot melt module mounted in the housing and located adjacent to the outlet.

2. The improved hot melt glue gun with an automatic glue stick feeding structure as claimed in claim 1, wherein the housing includes a first compartment and a second compartment, wherein the first compartment is located adjacent to and intercommunicates with the inlet, and wherein the second compartment is located adjacent to and intercommunicates with the outlet.

3. The improved hot melt glue gun with an automatic glue stick feeding structure as claimed in claim 1, wherein the casing includes a first casing part and a second casing part, and wherein the first casing part is located between the motor and the second casing part.

4. The improved hot melt glue gun with an automatic glue stick feeding structure as claimed in claim 3, wherein the motor includes a transmission shaft extending through a through-hole of the first casing part, wherein a transmission gear is mounted to the transmission shaft, and wherein the transmission gear is located in the casing and is driven by the transmission shaft to rotate.

5. The improved hot melt glue gun with an automatic glue stick feeding structure as claimed in claim 1, wherein the glue stick feeding module includes at least one upper gear and at least one lower gear located below and aligned with the at least one upper gear, and wherein the passage is defined between the at least one upper gear and the at least one lower gear.

6. The improved hot melt glue gun with an automatic glue stick feeding structure as claimed in claim 5, wherein the at least one upper gear and the at least one lower gear are mounted to two positioning shafts, respectively.

7. The improved hot melt glue gun with an automatic glue stick feeding structure as claimed in claim 1, wherein the activation module includes a fixed seat, and wherein an elastic element is mounted between the activation rod and the fixed seat.

8. The improved hot melt glue gun with an automatic glue stick feeding structure as claimed in claim 7, wherein the activation rod includes a first end, a second end, a larger-diameter pressing portion, and a smaller-diameter pressing portion, wherein the larger-diameter pressing portion is adjacent to the first end, and wherein the smaller-diameter pressing portion is adjacent to the second end.

9. The improved hot melt glue gun with an automatic glue stick feeding structure as claimed in claim 8, wherein the hot melt module includes a tube having an end aligned with the passage, and wherein the tube further has another end intercommunicating with the outlet.

10. The improved hot melt glue gun with an automatic glue stick feeding structure as claimed in claim 9, wherein the hot melt module includes a heating member fixed to an outer wall of the tube.

11. The improved hot melt glue gun with an automatic glue stick feeding structure as claimed in claim 9, wherein the tube is made of metal.

* * * * *